United States Patent [19]

Kalkowski

[11] 4,045,606

[45] Aug. 30, 1977

[54] PROTECTIVE COVER FOR AN ELECTRIC RANGE

[76] Inventor: Kurt Ulrich Kalkowski, Am Bleiberg 3, Mechernich-Kommern, Germany

[21] Appl. No.: 634,280

[22] Filed: Nov. 21, 1975

[30] Foreign Application Priority Data

Nov. 25, 1974 Germany ..... 2455693

[51] Int. Cl.[2] ..... B32B 1/00; B32B 3/00

[52] U.S. Cl. ..... 428/174; 428/189; 428/913; 428/604; 428/606; 99/446; 219/347; 219/462; 219/530

[58] Field of Search ..... 219/447, 453, 461, 462, 219/464, 347, 530, 540; 99/425, 444, 446; 126/211, 214; 29/180 SS, 183, 183.5; 106/39 DV; 206/56; 72/196; 154/125; 428/164, 174, 189, 913, 469

[56] References Cited

U.S. PATENT DOCUMENTS

| | | | |
|---|---|---|---|
| 3,490,123 | 1/1970 | Clark | 29/183 |
| 3,781,522 | 12/1973 | Boron et al. | 219/462 |

*Primary Examiner*—Volodymyr Y. Mayewsky
*Attorney, Agent, or Firm*—Burns, Doane, Swecker & Mathis

[57] ABSTRACT

A protective for a stove plate of an electric range comprises a heat-resistant aluminum foil into which bulges have been embossed corresponding to the heating units. The embossing is carried out by hand by laying a piece of foil on the stove plate and pressing the foil on and around the heating units. Stripes of a temperature-indicating salt, such as $NH_4MnP_2O_7$, which change color at a predetermined temperature are preferably applied to the foil to give visual indication of over-heating.

10 Claims, 7 Drawing Figures

PROTECTIVE COVER FOR AN ELECTRIC RANGE

Figure 1:
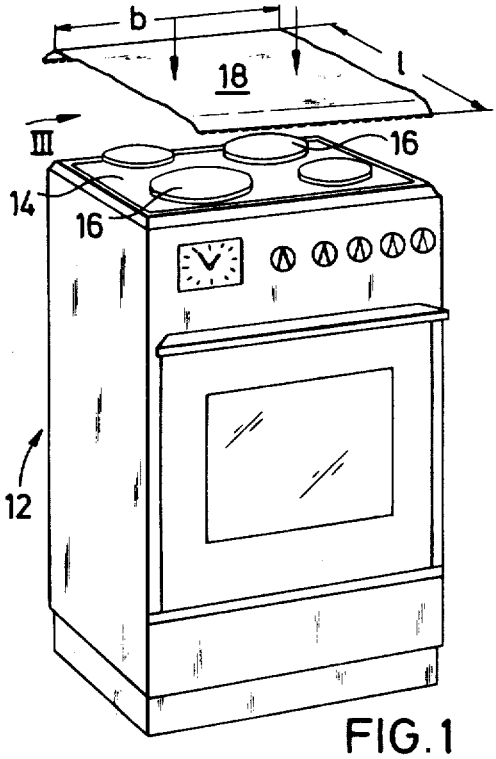

The invention relates to stove plates of electric ranges.

During cooking and frying on electric ranges the stove plates thereof, which are generally stainless steel or white enamelled, are frequently stained by the food which is being cooked overflowing, drops of fat spitting out, etc.

There is practically no protection against this and after cooking or frying the housewife must clean her stove plate with a cloth or sponge and in somecases with a detergent. This is an unpleasant and time-consuming task. Cleaning the stove plate in this manner is particularly irksome when the stains on the stove plate are practically burnt in by the heat produced during cooking and they then adhere particularly securely to the stove plate.

There does not exist any prior art device which the stove plate can be covered during cooking and frying to afford protection against standing. It is therefore desirable to provide a protective device for stove plates of electric ranges, which device is simple and economical both in construction and in utilisation. In accordance with the invention, a protective for a stove plate of an electric range comprises a heat-resistant metal foil into which bulges have been embossed which correspond to the shape of the heating units, the dimensions of the metal foil being adapted to the dimensions of the stove plate.

A commercially available metal foil of this type which is only fractions of a millimeter thick, is an ideal heat conductor, which does not inhibit the transmission of heat from the heating units to the pan or frying pan, and the thin metal foil is nevertheless sufficiently strong and impenetrable with respect to water, steam, drops of fat and the like, to prevent the stove plate from being stained with these substances and thus to keep it clean. The bulges which are embossed in the sheet and which enclose the heating units, hold said sheet on the stove plate, preventing it from slipping and shifting. It would impede cooking, frying and general tasks at the range if the metal foil and a pan, which might for example be disposed thereon, were to slip to and fro during stirring.

The metal foil catches the stains caused by food boiling over, spitting out and being spilled, and prevents them from reaching the stove plate. After a meal has been cooked these stains may be washed off with a damp cloth, or possibly in a wash basin under running water. A protective according to the invention may be used several times. Compared with its price the metal foil sheet thus has a long lifespan and the cost per meal amounts to only a few cents. On the other hand, its life-span is limited to only a few days. The housewife will, therefore, not clean the sheet with the same thoroughness and resultant difficulty as she would a stove plate. Cleaning is therefore restricted to a simple wipe-down and the housewife is in no danger of damaging her fingernails as she might during hard rubbing of the stove plate with a sponge and/or detergent.

A particular advantage in the utilisation of the metal foil to protect the range is that the cooking and frying times are shortened and consequently energy is saved. In the case of an electric range the heat does not only pass from the heating plate through the pan or frying pan into the food being cooked or fried, but also flows into the regions of the stove plate surrounding the heating units by simple heat transmission. The stove plate heats up and, as is known, reaches such high temperatures that it too can no longer be touched with the fingers. This high temperature of the heating plate in turn leads to transmission of heat to the surrounding air space. This transmission of heat is effected both by convection and radiation. Such heating of the surrounding air space is unnecessary and represents a heat loss. When the heating unit is covered by the metal foil sheet this transmission of heat to the air space is interrupted or at least greatly reduced. A cushion of practically unmoving air is produced between the heating units and the metal foil. This cushion stems the transmission of heat. An accumulation of heat is produced which returns to the heating units. This in turn leads to an increase in the temperature at the heating units. When the electrical energy supplied remains constant the cooking or frying time is reduced. Alternatively the amount of electrical energy supplied can be reduced.

Tests have shown that the cooking or frying time and thus the amount of energy used are approximately 10% below the values obtained when the metal foil is not used as a protective.

The shape and dimensions of the bulges are advantageously adapted to the shape and dimensions of the heating units such that the bulges lie on the heating units with a slight sliding fit. The protective is then adequately protected against slipping. At the same time the lines of the bends for the bulges in the metal foil sheet are not sharp enough for the sheet to tear at these points and thus become permeable.

The bulges can be formed particularly advantageously and simply, merely by pressing the metal foil against the heating units by hand. To this end the housewife places a piece of metal foil of accurately dimensioned length on the stove plate and then presses the foil down in the regions between the heating units. The circular shape of the bulges, which corresponds to the shape of the heating units, is made in the foil by the housewife placing both hands on the metal foil in the region of a heating unit and then pressing the foil down gently along the edges of the heating unit.

Any readily shaped metal and any alloy which can resist the temperatures of up to approximately 600° C constitutes a suitable material for the foil. Foils made of aluminum or an aluminum alloy are particularly advantageous. Foils made of aluminum and aluminum alloys are known and are on the market. Although the commercially available widths are not suitable for the production of the protective according to the invention, the manufacturers are attuned to the idea of rolling such foils and correspondingly economical production in large quantities is possible.

The heating units of electric cookers generally have diameters of varying sizes, some larger, some smaller. Accordingly, the bulges of the protective according to the invention have varying diameters. The length and the width of the protective of the invention are not critical, as long as the protective covers the stove plate adequately. However, on economical grounds and in order to keep manipulation easy, the length and width of the protective should only correspond to the depth and width of the stove plate. The housewife pulls off from a roll the length of foil required for one protective. So as to ensure that the length is measured correctly, marks are provided on an advantageous embodiment on both edges of the foil, which marks are spaced at a distance corresponding to the length or breadth of the stove. The housewife pulls the foil out until these marks are reached and then tears it off along the tear blade of the package.

Since many stoves are standardised to a size of 55 cm × 55 cm measured along their edges, the protective of the invention advantageously measures 55 cm × 55 cm along its edges.

However, the protective may also project widthwise beyond the stove plate at both sides.

As has already been stated the protective of the invention may be used several times. The flexibility of the metal foil allows said foil to be smoothed out after cleaning. This is effected simply by placing the foil on an even table top and stroking over it by hand. The protective of the invention, whether smoothed over or not, can also be folded up along a line of bend running centrally with respect to its longitudinal or cross dimension. The protective can thus be stored in a space-saving manner until it is next used.

An increasing number (already more than 50 %) of frying pans and vessels used today are coated with polytetrafluoroethylene. These PTFE layers prevent adhering during cooking and frying and enable frying with small amounts of fat. However, the layers are only resistant to a temperature of approximately 450° C. When this temperature has been reached, they begin to decompose and emit toxic fluorine vapours. Frying vessels and pans of this type may therefore only be heated to approximately 400° C, and the pans and vessels may only be sold with temperature-sensitive indicating and warning devices. An additional safeguard is to be provided with the invention in this respect. It is therfore proposed that at least one and preferably two stripes of a temperature-indicating salt, which changes colour at a temperature of approximately 400° C, be advantageously applied to the protective, said stripes running over the protective in the longitudinal direction and covering the heating units. Such temperature-indicating copper, cobalt, nickel, chromium, molybdenum and uranium salts exist, which at certain temperatures display a change in colour. A stripe of such a salt applied to the protective will display a marked change in colour at approximately 400° C. The housewife thereby becomes aware that the temperature must not increase any further and the heating unit must in some cases be re-set at a lower level. The colour-change temperature of 400° C is at an adequate level of safety below 450° C, at which temperature fluorine vapours are given off. Furthermore, this temperature is at an adequate level below 600° C, at which temperature the foil is softened by the action of the temperatures and loses its shape.

A salt which can be used for the above purpose and which changes colour from violet to white at a temperature of 400° C is ammonium manganese pyrophosphate ($NH_4MnP_2O_7$).

The various manufacturers do not always produce cookers with the heating units disposed in the same positions on the stove plate. However, substantially all manufacturers produce cookers with heating units which are disposed such that stripes running at a distance of 15 cm from the longitudinal edges of the foil will cover the heating units. This arrangement for the stripes is therefore proposed in an advantageous embodiment in order to ensure direct abutment of the stripes against the heating units, thus ensuring immediate heat transmission.

Figure 2:
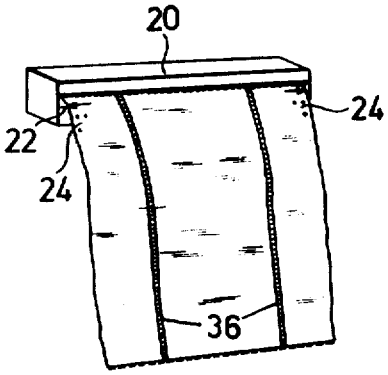
Figure 5:
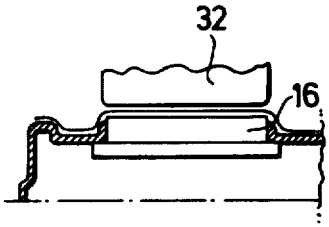
Figure 3:
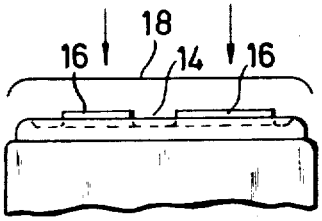
Figure 6:
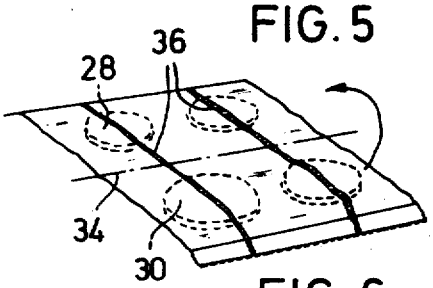
Figure 4:
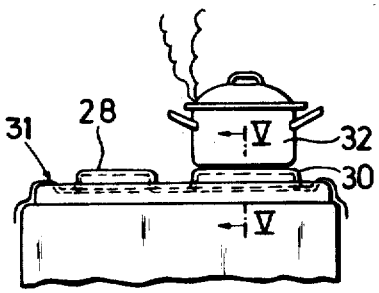
Figure 7:
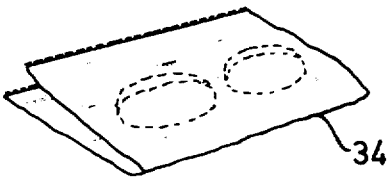

The invention is further described, by way of example, with reference to the accompanying drawings, in which:

FIG. 1 is a perspective view of an electric range having a piece of metal foil situated thereabove, prior to embossment, FIG. 2 is a perspective view of a package with a piece of metal foil pulled out to exactly the correct extent, FIG. 3 is a simplified side view of a stove plate with heating units and a piece of metal foil prior to embossment, FIG. 4 is a side view of a stove plate with a protective laid thereon and a pan placed thereon, FIG. 5 is a section along the line of section V — V in FIG. 4, FIG. 6 is a perspective view of a protective with particular regard to a line of bend running down the middle, and FIG. 7 is a perspective view of a protective after having been folded up.

FIG. 1 shows an electric range 12 having a stove plate 14 and heating units 16. A piece of metal foil 18 cut to the correct length is situated above the range. The length *l* of this piece of foil corresponds to the depth of the range 12 and the width *b* of the foil corresponds to the width of the range. The foil is pulled out of a package 20. FIG. 2 shows such a package which is mounted on a wall. The foil is severed along a tearing blade 22. In order to determine the length of the piece of foil which is to be severed, marks 24 are provided on the foil. These marks are printed or pressed on in any manner desired.

When a piece of foil of the correct length *l* has been pulled out and torn off, it is placed on the stove plate. FIGS. 1 and 3 show this positioning of the foil. The foil is then laid over the heating units 16 and is pressed against and around these plates in the direction of the arrows. The protective thus acquires its final shape, in which it is shown in FIGS. 4 and 6. The protective has smaller bulges 28 corresponding to the smaller heating units and the larger bulges 30 corresponding to the larger heating units as can be seen. In practice the protective does not lie on the stove plate and the heating units in exactly the shape as shown in FIG. 4 and in section in FIG. 5. At some points it lies closer to and at other points at a greater distance from the stove and heating units. In practice this is of no consequence. A frying or cooking vessel, such as the pan 32 illustrated, presses the foil against the heating units 16 simply by means of its own weight. This is decisive and adequate for the transmission of heat. The metal foil fulfils its main function of protecting the stove plate 14 against staining, irrespective of whether it abuts more or less closely or uniformly against the stove plate 14. A barrier 31 is formed at approximately the periphery of the stove top to catch spills from the top of the stove plate 14.

When cooking or frying has ended the protective is removed. FIG. 6 shows the foil in this form. The foil is wiped down with a damp cloth, possibly under running water, and can then be smoothed out, the bulges being pressed in in the course thereof. This process can be effected several times. Irrespective of whether prior smoothing out has been effected the protective can be folded along a line of bend 34 into the shape shown in FIG. 7. When folded up in this manner the foil can be stored away in a space-saving manner until it is next used.

FIGS. 2 and 6 also show stripes 36 of a salt which changes colour at a temperature of approximately 400° C. In the example shown in FIG. 6 the stripes 36 run centrally over the bulges 28 and 30 and in a corresponding manner over the heating units 16. In another arrangement of the heating units the stripes would run to the right or left of the middle line. In any case the stripes 36 cover the heating units 16 and can be seen in the region which is not covered by a frying or cooking vessel and their change in colour is immediately recognisable, giving the warning signal that the temperature of the heating unit is to be increased no further.

I claim:

1. A protective cover for an electric range having a stove plate and circular electric heating units comprising:

a piece of flexible heat resistant metal foil having good heat conductivity substantially covering said stove plate and said heating units;

bulges in said metal foil around said units and conforming to the shape thereof to prevent said protective cover from slipping on said plate during use and to enclose said heating units to reduce heat losses therefrom; and, at least one strip of a temperature indicating salt of a kind which changes color at a temperature of approximately 400° C so that said strip of salt extends over said heating units.

2. A protective according to claim 1 in which said foil consists of aluminum or an aluminum alloy.

3. A protective according to claim 1 in which said bulges have differing diameters.

4. A protective according to claim 1, in which said piece of foil measures substantially 55 cm × 55 cm.

5. A protective according to claim 1 in which said piece of foil has dimensions such that it projects widthwise beyond said stove plate at opposite sides thereof.

6. A protective according to claim 1 in which said foil has disposed thereon adjacent at least one of the two edges of the metal foil, marks which are spaced at a distance corresponding to the length of an edge of the top of said stove.

7. A protective according to claim 1 in which said piece of foil has a line of bend running centrally with respect to an edgewise surface dimension of said protective sheet so that the piece of foil can be folded up.

8. A protective according to claim 1, in which said stripe consists of $NH_4MnP_2O_7$.

9. A protective according to claim 1 in which said foil has thereon two stripes of a temperature-indicating salt, each such stripe being at a distance of substantially 15 cm from a respective longitudinal edge of the foil.

10. A protective cover for an electric range having a stove plate and circular electric heating units comprising:

a piece of flexible heat resistant metal foil having good heat conductivity substantially covering said stove plate and said heating units;

bulges in said metal foil around said units and conforming to the shape thereof to prevent said protective cover from slipping on said plate during use and to enclose said heating units to reduce heat losses therefrom; and, grooves in said piece of metal foil between said bulges and the ends of said piece of metal foil to catch spills from the top of the stove.

* * * * *